US006609483B1

(12) United States Patent
Albrecht et al.

(10) Patent No.: US 6,609,483 B1
(45) Date of Patent: Aug. 26, 2003

(54) SYSTEM FOR CONTROLLING FLUE GAS EXIT TEMPERATURE FOR OPTIMAL SCR OPERATIONS

(75) Inventors: Melvin J. Albrecht, Homeworth, OH (US); John B. Rogan, Roswell, GA (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/085,715

(22) Filed: Feb. 27, 2002

(51) Int. Cl.[7] ..... F22G 5/04
(52) U.S. Cl. ..... 122/479.2; 122/166.2
(58) Field of Search ..... 122/467, 468, 122/479.2, 135.1, 155.1, 159, 166.2; 110/345, 245; 60/666, 676

(56) References Cited

U.S. PATENT DOCUMENTS 4,887,431 A * 12/1989 Peet ..... 60/667
5,555,849 A * 9/1996 Wiechard et al. ..... 122/4 D
5,603,909 A * 2/1997 Varner et al. ..... 423/239.1
5,713,311 A * 2/1998 Fitzgerald ..... 122/406.5
5,943,865 A * 8/1999 Cohen ..... 60/653
5,988,115 A * 11/1999 Anderson et al. ..... 122/4 D
6,510,820 B1 * 1/2003 McDonald ..... 122/155.1

* cited by examiner

*Primary Examiner*—Gregory Wilson
(74) *Attorney, Agent, or Firm*—Kathryn W. Grant; Eric Marich

(57) ABSTRACT

A system for maintaining an optimal flue gas inlet to a boiler mounted SCR assembly in the flue of the boiler is accomplished by mixing the normal inlet feedwater to an economizer of the boiler with near saturation water from downcomers of the boiler to thereby raise the temperature of the flue gas passing across the economizer and raising the SCR inlet to the desired optimal SCR operation temperature.

9 Claims, 2 Drawing Sheets

SYSTEM FOR CONTROLLING FLUE GAS EXIT TEMPERATURE FOR OPTIMAL SCR OPERATIONS

FIELD AND BACKGROUND OF THE INVENTION

The present invention is generally drawn to broilers using SCR (Selective Catalytic Reduction) systems at the flue exhaust to clean the exhaust gas thereby and more particularly to the optimized temperature operation of the same.

In operating a boiler with a Selective Catalytic Reduction system, or SCR, at the flue gas exhaust, the reactiveness of the catalyst is dependent upon the flue gas temperature entering the catalyst reactor. A given catalyst will have maximum performance when it is operated at the temperature of peak performance (TPP). As an example, in a typical SCR for $NO_x$ removal, the temperature of peak performance (typically 650° F.) at the reaction of ammonia with $NO_x$ present in the flue gas is optimized and the amount of the ammonia needed for the catalytic reaction is minimized. Therefore, for economic reasons the desired gas temperature entering the catalyst reactor should be maintained at the TPP at all loads. Also, maintaining the desired flue gas temperature reduces the formation of ammonia and/or sulfate salts within the ammonia injection grid (AIG) and the catalyst.

However, as boiler load decreases, the boiler exit gas temperature will drop below the TPP. To increase the gas temperature to TPP, current practice has been to use an economizer gas bypass. The economizer gas bypass is used to bypass the hotter gases upstream of the economizer to the cooler gas that leaves the economizer and mixes with the flue gas. By controlling the amount of gas that passes through the bypass system, a boiler exit flue gas temperature of approaching the TPP can be maintained at the lower boiler loads which normally results in the flue gas temperature below TPP.

Also, systems for mixing economizer feedwater with hot water at the inlet of the economizer are known. These systems were known as the Off Line Circulation System and were developed in the mid 1980s. However, this system was not designed for increasing the flue gas temperature from the economizer. This system's main purpose was to reduce the economizer inlet headers thermal shock that occurs during boiler start up and shut down and to eliminate the stratification/subcooling temperature effects that occur in the furnace walls of the boiler when the boiler is off line and put into hot standby.

Thus, what was needed was a simpler system that required less physical space to obtain the desired flue gas temperature to the SCR at various boiler loads. With the known flue gas bypass systems currently used for SCR application, static mixing devices, pressure reducing vanes/plates and thermal mixing devices were required to make the different temperature flue gases mix before the gas mixture reaches the inlet of the catalyst reactor. In most applications, obtaining the strict mixing requirements for flow, temperature and the mixing of the reagent (if received) before the catalyst reactor was often difficult.

SUMMARY OF THE INVENTION

The present invention solves the problems associated with prior art devices as well as others by providing a boiler water recirculation system where the variation in the gas flow and temperature at the economizer outlet is less severe than with a flue gas bypass system, making it easier to meet the gas mixing requirement for the catalyst reactor at the optimal inlet temperature.

To accomplish this, the invention uses the economizer to increase the outlet temperature of the flue gases to the desired temperature at the lower boiler loads by using a boiler recirculation system to provide higher temperature water from the circulation system that is used to cool the furnace walls. The recirculation system supplies near saturation water from the downcomers of drum circulation boiler applications, or for once-through boiler applications, the fluid is obtained from a fluid mix location in the upper region of the lower furnace. In either a drum or once through boiler application, the higher temperature water is transferred to the economizer inlet and mixed with the boiler's economizer normal feedwater inlet flow. The mixture of the two fluid streams results in a higher temperature fluid in the economizer that can be used to increase the flue gas temperature leaving the economizer. With proper adjustment of the different fluid streams to the economizer, the desired flue gas temperature can be obtained for any boiler load. The amount of near saturation water (or higher temperature furnace wall water for a once-through boiler) from the boiler recirculation system is controlled throughout the load range. Calculations have shown that no catastrophic effects (critical heat flux or tube failures) on the cooling of the boiler's furnace walls will occur in the use of this system.

In view of the foregoing it is seen that one aspect of the present invention is to provide stable flue gas temperature control system based on economizer water inlet temperature.

Yet another aspect of the present invention is to provide an increased temperature economizer gas outlet responsive to increased economizer water inlet temperature.

These and other aspects of the present invention will be more fully understood upon a review of the following description of the preferred embodiment when considered in conjunction with the accompanying drawings.

DESCRIPTION OF THE PREFERRED EMBODIMENTS

Figure 1:
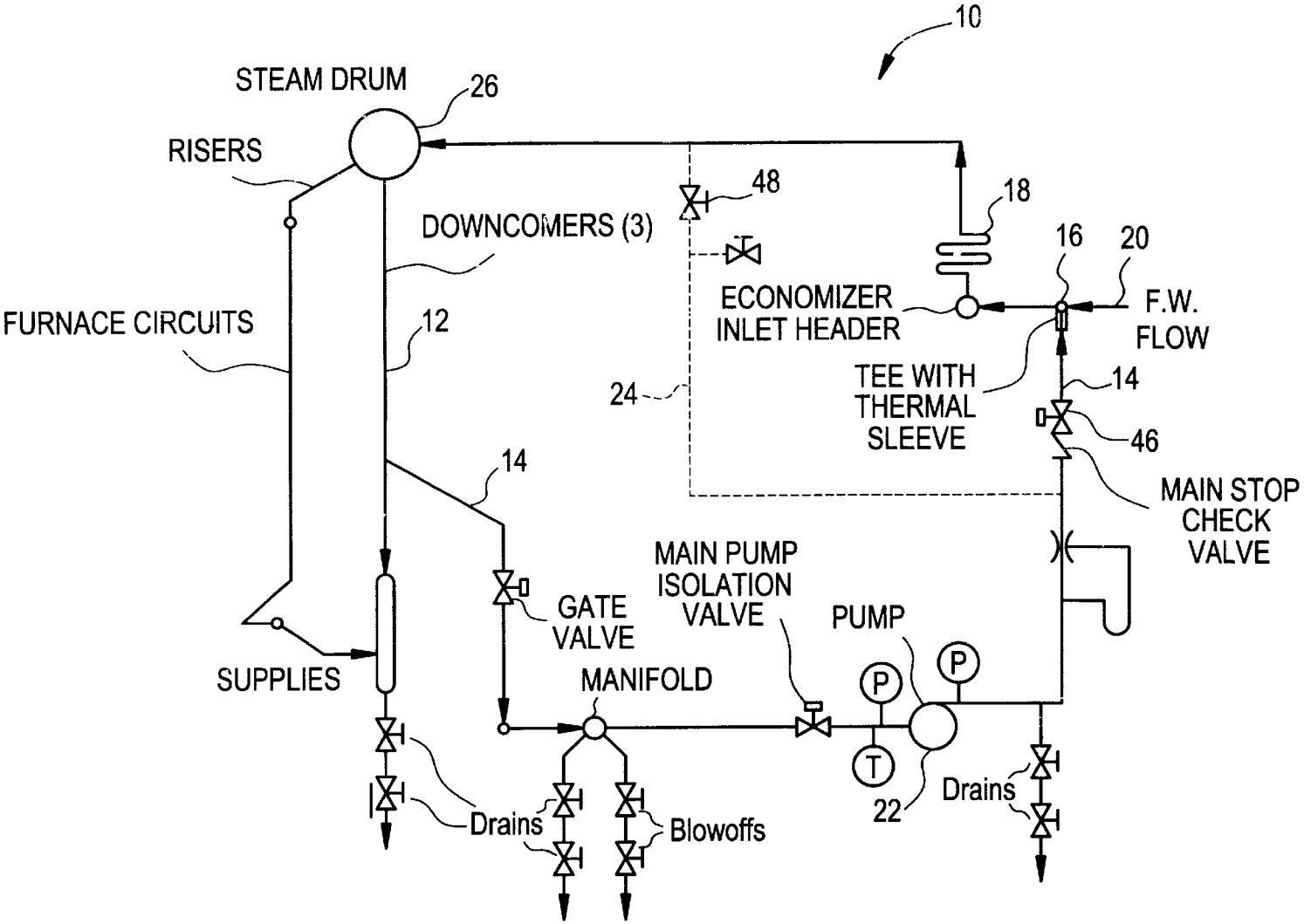
FIG. 1 is a schematic of a boiler water/steam recirculation system utilizing the increased temperature economizer water inlet of the present invention.
Figure 2:
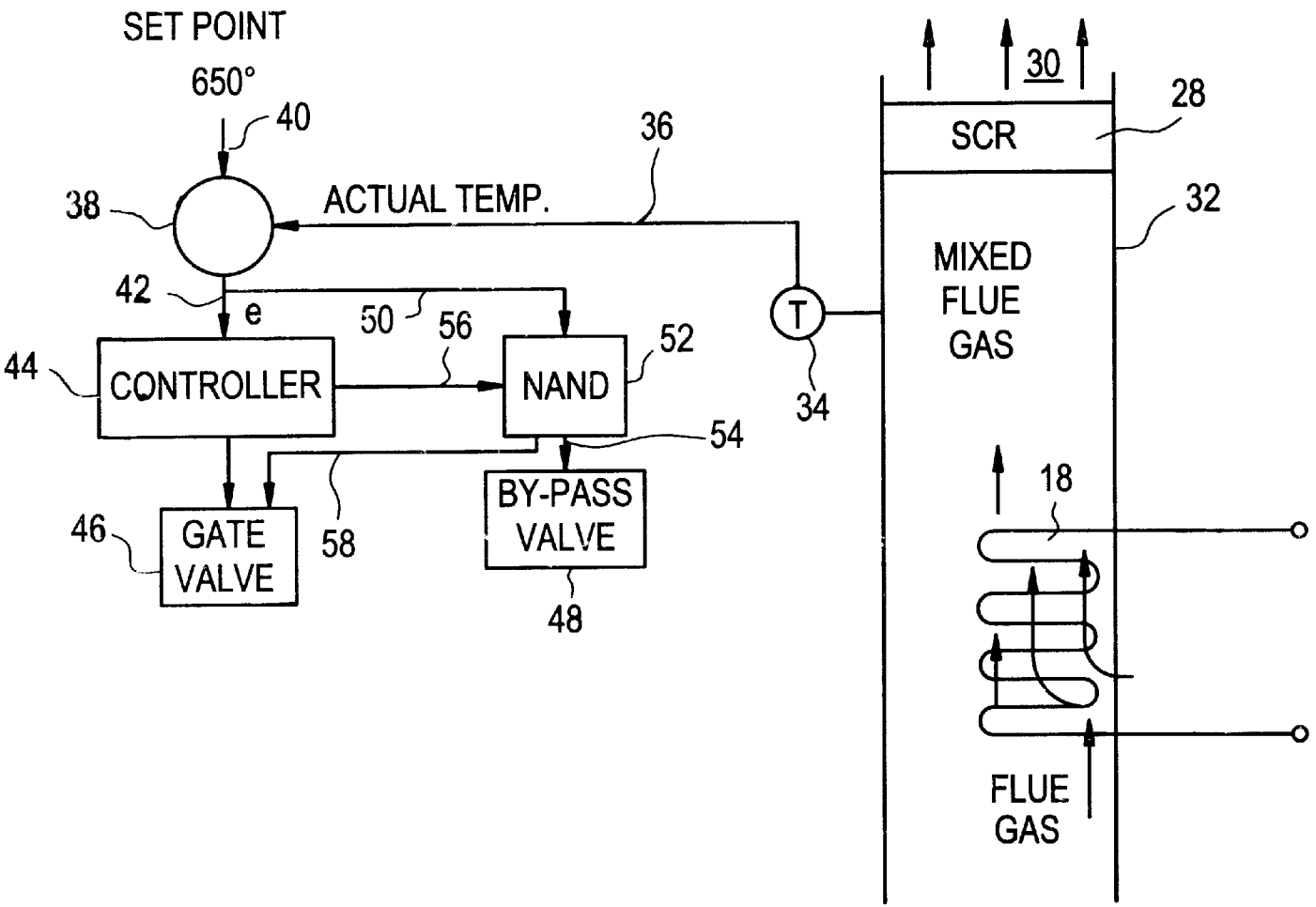
FIG. 2 is a schematic of the control system used to increase flue gas temperature in response to increased economizer water inlet temperature.

Referring to FIGS. 1 and 2 of the drawings, the present invention uses a different approach to obtaining a TPP boiler exit flue gas temperature. In a normal boiler application, the water side of the economizer is used to cool the flue gas that flows over the surface that is installed in the boiler. Here, the boiler recirculation system (10) is modified to have higher temperature water near saturation from downcomers (12) connected by a bypass line (14) to an inlet (16) of an economizer (18). The inlet (16) is a tee inlet with the other inlet of the tee providing normal feedwater flow from line (20). The flow through line (14) is provided by a pump (22) which has monitoring, flow T and pressure P sensors mounted on both sides of the pump (22). An economizer (18) bypass line (24) is provided as shown in dotted lines on FIG. 1, to recirculate the downcomers (12) saturated water back thereto from drum (26) when no increased water temperature is needed for mixing with the normal economizer (18) feedwater from line (20).

With particular reference to FIG. 2, it will be seen that the operation of this invention is as follows. An SCR (28) located on an outlet (30) of a boiler flue (32) needs the optimum flue gas temperature supplied to the inlet thereof for optimal operation as was described earlier. To accomplish this end, a temperature sensor (34) is mounted in a flue (32) near the entrance to the SCR (28) to monitor the flue gas temperature. A signal indicative of the actual flue gas is transmitted along line (36) to comparator station (38) having a set point signal of the optimum temperature inputting thereto along line (40). Any difference in these two signals develops an error signal e along line (42) to a controller (44) which controls the opening of a gate valve (46) to control the quantity of satuation temperature water sent along line (14) to the tee (16) to be mixed with the normal temperature feedwater from line (20) and supplied to the economizer (18).

The bypass line (24) is closed by normally closed valve (48) being maintained closed by the error signal e being transmitted along line (50) to a NAND gate (52). As long as there is a positive signal from comparator (38) to the NAND gate (52), there will be no control signal passed therefrom along line (54) to the valve (48) and it will remain shut. When the error e signal becomes O indicating a flue gas temperature is at the optimum, a O signal will enter NAND gate (52) along line (50) an O signal will enter the NAND gate (52) along line (56)from the controller (44). This will cause an output control signal to be transmitted along line (54) to normally closed valve (48) to open and a control signal along line (58) to the normally open valve (46) to close. This establishes flow back to the downcomers (12) bypassing the economizer (18) until the flue (32) temperature falls below 650° F. and saturated water will again be mixed with normal feedwater to the economizer (18) inlet.

Clearly as more saturated water is inputted to the inlet of the economizer (18) the flue temperature across the economizer (18) will rise and, when mixed with normal flue gas, will raise the temperature to the temperature of peak performance at the SCR (28) inlet.

Certain modifications and construction details have been deleted herein since they are obvious to those of ordinary skill in the art area and for the sake of conciseness and readability but are properly within the scope of the following claim.

We claim:

1. A system for maintaining an optimal flue temperature to the inlet of an SCR assembly mounted therein comprising;

a boiler having an economizer mounted in the flue thereof;

a boiler downcomer having water therein near saturation temperature;

an economizer water inlet providing a mixture of normal feedwater and water from said downcomer; and a control system for mixing the water inlet to insure that the flue temperature of the inlet to the SCR is optimal.

2. A system as set forth in claim 1 wherein said control system includes a temperature sensor mounted at the inlet of the SCR to monitor flue temperature and a controller to vary the quantity of water from said downcomer to said economizer water inlet in response to a difference between optimal SCR inlet temperature and actual inlet temperature.

3. A system as set forth in claim 2 wherein said control system includes a comparator for developing an error signal based on the difference between optimal SCR inlet temperature and actual inlet temperature, the system including a controller connected to said comparator for controlling a valve varying the water flow from said downcomer to said economizer inlet.

4. A system as set forth in claim 3 including a bypass for connecting the water flow from said downcomer to the water outlet of said economizer when the SCR inlet temperature was optimal.

5. A boiler water recirculation system comprising;

a boiler having downcomers and an economizer connected to a boiler drum;

said economizer having an inlet for mixing normal feedwater with water from said downcomers; and wherein the amount of water from said downcomers is proportional to the difference between actual and desired flue gas temperature from the boiler.

6. A boiler recirculation system as set forth in claim 5 wherein the mixing of water from said downcomer in said inlet is done with a fixed feedwater flow.

7. Apparatus for maintaining the temperature of boiler flue gas conveyed from a boiler to a selective catalytic reduction system with an economizer therebetween, the boiler having a circulation system containing water therein at near saturation temperature, the economizer having an economizer water inlet, the apparatus comprising:

a feedwater line for supplying economizer feedwater;

a first bypass line connected to the circulation system for transferring near saturation temperature water from the circulation system to the economizer water inlet;

mixing means, connected to the feedwater line and the first bypass line, for mixing the feedwater and near saturation temperature water and supplying the mixture to the economizer water inlet; and control means for controlling the quantity of saturation temperature water supplied to the mixing means.

8. The apparatus of claim 7 wherein the mixing means comprises a tee having an inlet connected to the feedwater line, another inlet connected to the bypass line and an outlet connected to the economizer water inlet.

9. The apparatus of claim 7 further comprising a second bypass line connected to the first bypass line for recirculating saturation temperature water directly back to the circulation system without passing through the economizer.

* * * * *